US005734673A

United States Patent [19]

Kurahashi et al.

[11] Patent Number: 5,734,673

[45] Date of Patent: Mar. 31, 1998

[54] WASTE-MELTING FURNACE AND WASTE-MELTING METHOD

[75] Inventors: Takafumi Kurahashi, Nagoya; Katsutoshi Torita, Handa, both of Japan

[73] Assignee: NGK Insulators, Ltd., Japan

[21] Appl. No.: 694,460

[22] Filed: Aug. 7, 1996

[30] Foreign Application Priority Data

Aug. 10, 1995 [JP] Japan ..... 7-204563

[51] Int. Cl.[6] ..... H05B 7/00

[52] U.S. Cl. ..... 373/20; 373/2; 373/18; 373/22; 373/24

[58] Field of Search ..... 373/2, 3, 18, 19, 373/20, 24

[56] References Cited

U.S. PATENT DOCUMENTS

| | | | |
|---|---|---|---|
| 3,937,866 | 2/1976 | Sunnen et al. | 373/20 |
| 5,028,248 | 7/1991 | Williams et al. | 373/20 |
| 5,245,627 | 9/1993 | Drouet | 373/20 |
| 5,408,494 | 4/1995 | Schlienger | 373/20 |
| 5,548,611 | 8/1996 | Cusick et al. | 373/18 |

FOREIGN PATENT DOCUMENTS

| | | |
|---|---|---|
| 625 869 | 11/1994 | European Pat. Off. . |
| 64-6611 | 1/1989 | Japan . |

OTHER PUBLICATIONS

Patent Abstracts of Japan, vol. 014, No. 374 (E-0964), 13 Aug. 1990 & JP 02 135711 A (Daido Steel Co Ltd), 24 May 1990 (Abstract only).

*Primary Examiner*—Tu B. Hoang
*Attorney, Agent, or Firm*—Parkhurst & Wendel, L.L.P

[57] ABSTRACT

A waste-melting furnace includes a furnace body, a rotary heat-resistive vessel which is arranged inside the furnace body and into which waste is to be fed, and a transferred arc type torch plasma gun and a water-cooled electrode arranged above the rotary heat-resistive vessel, the plasma gun and electrode being opposed to each other.

5 Claims, 2 Drawing Sheets

WASTE-MELTING FURNACE AND WASTE-MELTING METHOD

BACKGROUND OF THE INVENTION (1) Field of the Invention

The present invention relates to a waste-melting furnace and a waste-melting method suitable for disposal of solid waste produced in general industrial plants, municipal waste, radioactive mixed solid waste from atomic plants, etc.

(2) Related Art Statement

Solid waste produced in general industrial plants, municipal waste, radioactive mixed solid waste from atomic plants, etc. contain nonflammables such as metals and ceramics and inflammables such as paper and resin. In order to dispose of such waste, it is conventionally known that the waste is divided into nonflammables and inflammables, the inflammables are burnt, and particularly a radioactive nonflammable material is converted into solidified glass by melting it in a high frequency wave melting furnace or the like. However, since this process requires the nonflammable material to be separated from the inflammable, a worker may be exposed to radiation during the separating process if the radioactive mixed solid waste is disposed of.

JP-A-64 6611 mentions a process for solving the above problem. According to an apparatus described in this publication, a nonflammable material and an inflammable material are fed together into a furnace with a plasma gun, and by utilizing high temperature such as tens thousand centigrades realized by the plasma gun, the inflammable material can be burnt out and the nonflammable material can be melted.

However, in the apparatus described in this publication, a ground electrode is arranged in a central portion of a rotary heat-resistive vessel into which the waste is fed, and a plasma bloom is blown toward the electrode inside the rotary heat-resistive vessel through the plasma gun attached to the furnace body. Accordingly, the electrode contacts the melt, so that maintenance is not easy if the electrode is damaged or abraded. If the refractory of the rotary heat-resistive vessel is damaged or abraded through contact between the melt and the refractory, the electrode as well as the entire refractory must be exchanged. Consequently, the running cost increases. In addition, it has been necessary to make a complicated operation for taking out the melt from the rotary heat-resistive vessel upwardly after the melt is solidified or through the bottom of the rotary heat-resistive vessel.

The present invention has been developed to solve the above-mentioned problems of the prior art and to provide a waste-melting furnace and a waste-melting method, wherein a nonflammable material need not be separated from an inflammable material, maintenance for the electrode and the refractory is easy, the running cost is lower, and the operation is easy.

The waste-melting furnace according to the present invention, which has been made to accomplish the above mentioned object, comprises a furnace body, a rotary heat-resistive vessel that is arranged inside the furnace body and into which a waste is to be fed, and a transferred arc type torch plasma gun and a water-cooled electrode arranged above the rotary heat-resistive vessel, said plasma gun and electrode being opposed to each other.

The waste-melting method according to the present invention comprises the steps of charging a waste into a rotary heat-resistive vessel, and melting the waste with heat of a plasma formed between a transferred arc type torch plasma gun and a water-cooled electrode arranged above the rotary heat-resistive vessel, said plasma gun and electrode being opposed to each other.

As a preferred embodiment of the waste-melting furnace according to the present invention, the waste-melting furnace includes a lift table for vertically moving the rotary heat-resistive vessel. Further, a rotary heat-resistive vessel-tilting unit is preferably provided for receiving the rotary heat-resistive vessel and tilting the heat-resistive vessel in a place where the lift table is lowered. The tilting unit is preferably arranged at a lowermost end position up to which the lift table is lowered.

Furthermore, a mold is preferably provided near the tilting table so that the melt may be poured into the mold from the rotary heat-resistive vessel by tilting the vessel by means of the tilting table.

These and other objects, features and advantages of the invention will be appreciated from the following description of the invention when taken in conjunction with the attached drawings, with the understanding that some modifications, variations and changes of the same could be easily made by those skilled in the art to which the invention pertains.

BRIEF DESCRIPTION OF THE DRAWINGS

For a better understanding of the invention, reference is made to the attached drawings, wherein:

FIG. 1(*b*) is a schematic view for illustrating a tilted state of a rotary vessel-tilting table;

DETAILED DESCRIPTION OF THE INVENTION

A preferred embodiment according to the present invention will be explained in more detail with reference to the attached drawings.

Figure 1A:
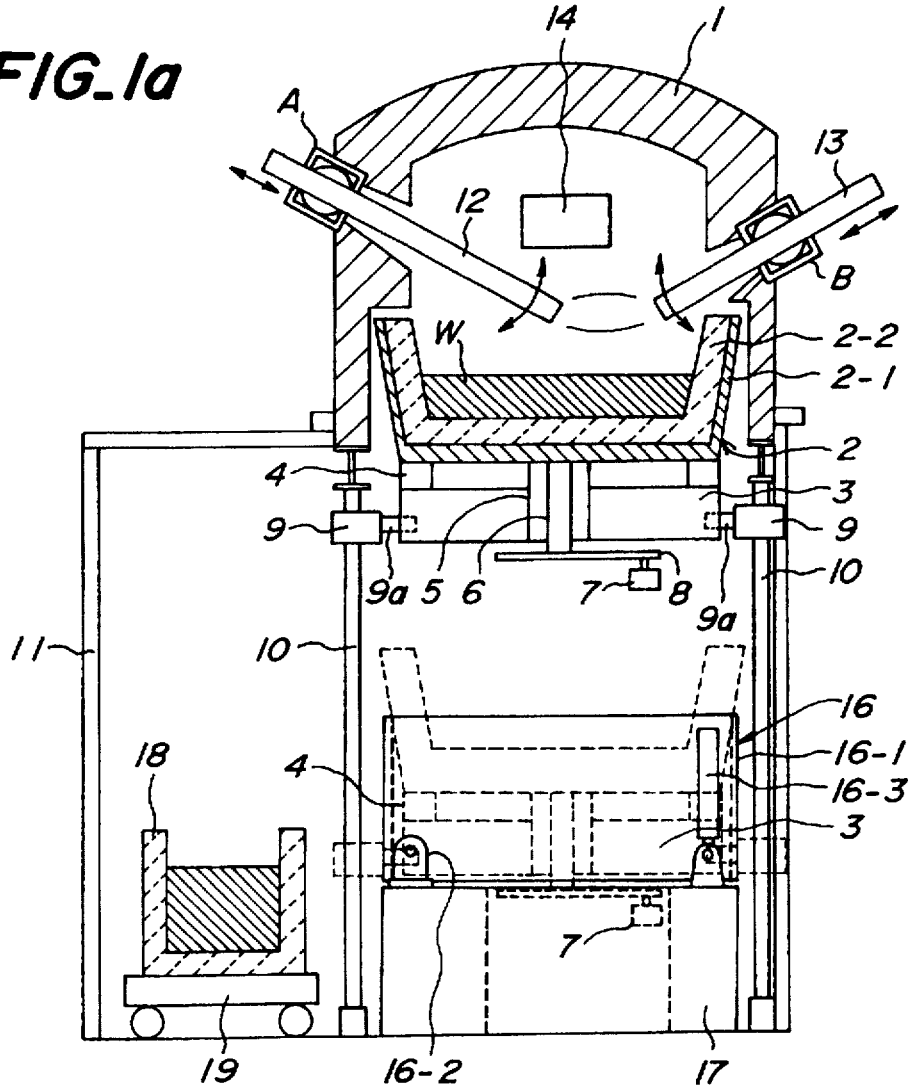
FIG. 1(*a*) is a vertical sectional view of a waste-melting furnace.
Figure 1B:
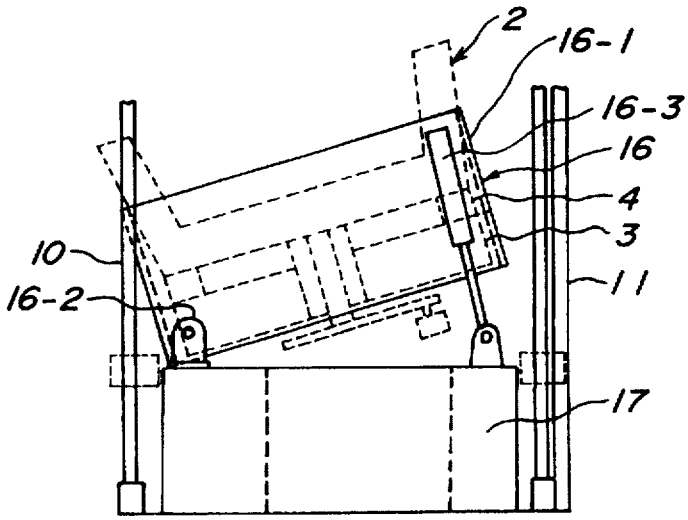
Figure 2:
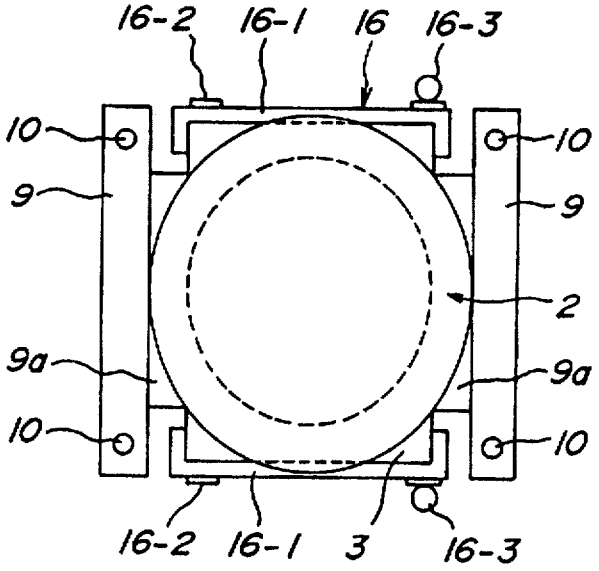
FIG. 2 is a plan view of a principal portion of the waste-melting furnace in FIG. 1(*a*)
Figure 3:
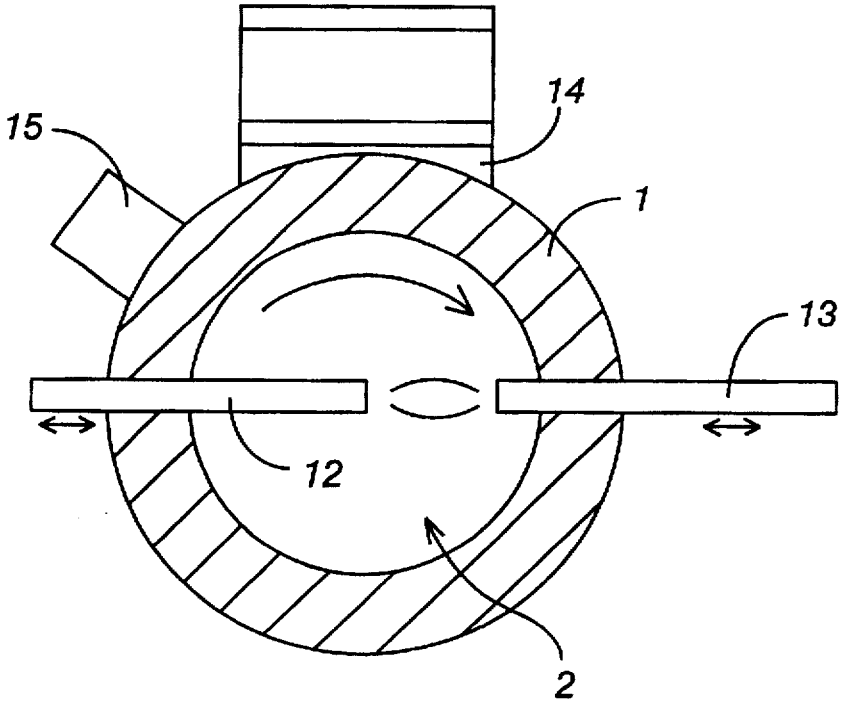
FIG. 3 is a horizontally sectional view of the waste-melting furnace.

In FIGS. 1(*a*) and 1(*b*), FIG. 2 and FIG. 3, a reference numeral 1 denotes a cylindrical furnace body with no bottom, and a rotary heat-resistive vessel 2 is arranged inside the furnace body 1. The furnace body 1 may be constituted by an outer shell made of steel and a refractory lining along an inner side of the outer shell. As the refractory lining, alumina bricks or magnesia bricks may be used. The furnace body 1 may be cooled with water, if necessary. The rotary heat-resistive vessel 2 is also constituted by an outer shell 2-1 made of steel and a refractory lining 2-2 covering the inner surface of the outer shell. The rotary heat-resistive vessel 2 is placed on a lift table 3 via an intermediate insert member 4, while a bush cylinder 5 and a rotary shaft 6 are connected to a central portion of the bottom face of the rotary vessel 2 at one end thereof. The other end of the rotary shaft 6 is connected to a motor 7 fixedly provided under the lift table via a connecting means 8 such as an endless belt. The rotary vessel 2 is rotated by the motor 7 in a given direction, while the vessel 2 is slid on the intermediate insert member 4.

As shown in FIGS. 1(*a*) and 1(*b*), a pair of clamping units 9 are vertically movably passed through screw-shaft guides 10, and clamping blades 9*a* are releasably inserted into clamping holes at sides of the lift table 3 for holding the lift table 3. Under the furnace body 1 is provided a gas-tight box 11 in which the guides 10 are vertically extended.

A water-cooled electrode 12 and a transferred arc type torch plasma gun 13 are inserted into a space above a waste W charged in the rotary heat-resistive vessel 2 inside the furnace body 1 through ball & socket type omnibus directional supporting members A and B, respectively such that the tips of the electrode 12 and and the plasma gun 13 are opposed to and spaced from each other. As shown in FIGS. 1(*a*) and 1(*b*) and FIG. 3, the tip of the water-cooled electrode 12 is arranged near a rotary center of the rotary heat-resistive vessel 2, whereas the plasma gun 13 is arranged to have its tip located near one peripheral side of the rotary heat-resistive vessel 2.

The lift table 3 is vertically moved along the guides 10 by rotating the guides 10 by means of a appropriate driving means not shown.

Although not shown in detail, the water-cooled type electrode 12 in this embodiment includes an electrode body made of copper, and a water-cooled jacket surrounding an outer periphery of the electrode body except that a tip portion is uncovered. The electrode 12 is positionally adjusted through the supporting member A in longitudinal and circumferential directions as shown by arrows. Although not shown in detail, the plasma gun 13 in this embodiment is a water-cooled plasma gun of a transferred arc type torch which includes a plasma gun body made of copper and a water-cooled jacket surrounding an outer periphery of the plasma gun body except that a tip portion is uncovered. The plasma gun is also positionally adjusted through the supporting member B in longitudinal and circumferential directions as shown by arrows. Argon gas is fed into the furnace body 1 through the plasma gun 13. In the electrode 12 and the plasma gun 13, carbon may be used instead of copper. Further, instead of copper, another metal such as tungsten may be used. Instead of argon gas, nitrogen gas or air may be used. Plasma at tens of thousands °C. can be generated by applying DC voltage between the water-cooled electrode 12 and the plasma gun 13.

In the furnace body 1 are provided a waste feed opening 14 and an exhaust gas outlet 15 as well as a combustion air feed opening not shown. A rotary heat-resistive vessel-tilting unit 16 is provided in a lower portion among the guides 10 provided on a base table 17. The tilting unit 16 includes a pair of opposed receiving plates 16-1, hinges 16-2 and hinged extension cylinders 16-3. First ends of hinges 16-2 and the cylinders 16-3 are fixed to the base table 17, and their other ends are pivotably fixed to sides of the receiving plates 16-1. The tilting table 16 receives the rotary heat-resistive vessel 2 descended by the lift table 3, and the rotary heat-resistive vessel 2 is moved onto the tilting unit 16 from the lift table 3 by releasing the clamping blades 9*a* of the clamping unit 9. The rotary heat-resistive vessel-tilting unit 16 is to be tilted by the hydraulic oil cylinder 16-3. On a side of the tilting unit 16 and the the base table 17 is provided a mold 18 for receiving a melt from the rotary heat-resistive vessel 2. In this embodiment, the mold 18 is placed on a wheeled truck 19 so that the mold 18 may be easily taken out for post handling. The guides 10, the tilting unit 16, the base table 17, and the mold 18 are accommodated in the gas-tight box 11.

Next, the way of using the above mentioned waste-melting apparatus will be explained.

First, a waste such as a radioactive mixed solid waste is fed into the rotary heat-resistive vessel 2 through the waste feed opening 14 without separating a nonflammable component from an inflammable component. While the rotary heat-resistive vessel 2 is being rotated, plasma at tens of thousands °C. is produced between the water-cooled electrode 12 and the plasma gun 13 under application of DC voltage therebetween. The mixed solid waste is heated inside the rotary heat-resistive vessel 2 with radiation heat from the high temperature plasma and radiation heat from the inner wall of the heated furnace body 1. As a result, the inflammable component is burnt with air fed through the air feed opening or the plasma gun 13, and a nonflammable material such as a metal and ceramics is melted. Plasma is produced along a radius at one side of the center of the rotary heat-resistive vessel 2. However, since the rotary heat-resistive vessel 2 is rotated, the waste is uniformly heated.

When the mixed solid waste is melted in the rotary heat-resistive vessel 2 in this manner, fresh mixed solid waste is fed into the vessel 2 and melted therein in the same manner. When the melt inside the rotary heat-resistive vessel 2 reaches a given amount, production of the plasma is stopped, and the rotary heat-resistive vessel 2 is lowered by means of the guides 10. Then, the vessel is placed onto the tilting unit 16 by releasing the clamping blades 9*a*, and is tilted by the rotary heat-resistive vessel tilting unit 16 as shown in FIG. 1(*b*). Thereby, the melt is poured into the mold 18. The melt is cured to a solidified glass body inside the mold 18, which glass body will be finally disposed of.

The plasma gun may be intermittently operated. Further, the operations of the electrode 12 and the plasma gun 13 may be programed in a computer, and controlled thereby. According to the present invention, since the water-cooled electrode 12 and the plasma gun 13 are located above the waste in the rotary heat-resistive vessel 2, they do not contact the melt, and maintenance of the water-cooled electrode 12 is easy. Even if the refractory 2-2 of the rotary heat-resistive vessel 2 is damaged or abraded, only the refractory can be exchanged by one-touch operation in the state that the rotary heat-resistive vessel 2 is lowered. Therefore, maintenance of the rotary heat-resistive vessel 2 is extremely easy.

As having been explained, according to the waste-melting furnace and the waste-melting method of the present invention, the nonflammable material and the inflammable material can be simultaneously treated without being separated from each other. Further, since neither the electrode nor the plasma gun contacts the melt, maintenance of the waste-melting furnace is easy, including the exchanging of the refractory of the rotary heat-resistive vessel, so that the running cost can be reduced as compared with the conventional apparatus. Further, since the rotary heat-resistive vessel is lowered and tilted, the melt can be easily taken out from the vessel. Therefore, the present invention solves the problems of the prior art, and is suitable for the treatment of various wastes as the waste-melting furnace and the waste-melting method.

What is claimed is:

1. A waste-melting furnace comprising a furnace body, a rotary heat-resistive vessel which is arranged inside the furnace body and into which waste is to be fed, and a transferred arc type torch plasma gun and a water-cooled electrode arranged above, and spaced from melted waste contained in, the rotary heat-resistive vessel, said plasma gun and electrode being opposed to each other.

2. The waste-melting furnace set forth in claim 1, further comprising a lift table for vertically moving the rotary heat-resistive vessel, and a rotary heat-resistive vessel-tilting unit for receiving the rotary heat-resistive vessel and tilting the heat-resistive vessel in a position where the lift table is lowered.

3. The waste-melting furnace set forth in claim 2, further comprising a mold provided adjacent the tilting unit for receiving melt poured from the rotary heat-resistive vessel, by tilting the vessel by means of the tilting unit.

4. A waste-melting method comprising the steps of:

charging waste into a rotary heat-resistive vessel, and melting the waste with heat of a plasma formed between a transferred arc type torch plasma gun and a water-cooled electrode arranged above, and spaced from the melted waste contained in, the rotary heat-resistive vessel, said plasma gun and electrode being opposed to each other.

5. The waste-melting method of claim 4, wherein an arc is generated between the electrode and the plasma gun, and said arc passes therebetween without passing through the melt to generate heat.

* * * * *